United States Patent [19]

Plunkett

[11] 4,188,858

[45] Feb. 19, 1980

[54] BUMPER DETERIORATION WARNING SYSTEM FOR FASTENER DRIVING TOOLS

[75] Inventor: Larry D. Plunkett, Crystal Lake, Ill.

[73] Assignee: Signode Corporation, Glenview, Ill.

[21] Appl. No.: 904,774

[22] Filed: May 11, 1978

[51] Int. Cl.[2] ..... F15B 15/20; F01B 11/02

[52] U.S. Cl. ..... 91/392; 91/402; 91/417 A; 92/85 R; 227/130

[58] Field of Search ..... 227/130; 173/139; 91/417 A, 402, 392; 92/5, 85 R

[56] References Cited

U.S. PATENT DOCUMENTS

| | | | |
|---|---|---|---|
| 3,208,353 | 9/1965 | Wandel | 227/130 |
| 3,351,256 | 11/1967 | Readyhough | 227/130 |
| 3,651,740 | 3/1972 | Perkins | 92/85 R |
| 3,822,819 | 7/1974 | Wilson et al. | 227/130 |

*Primary Examiner*—John McQuade

*Attorney, Agent, or Firm*—Dressler, Goldsmith, Clement, Gordon & Shore, Ltd.

[57] ABSTRACT

A warning system for pneumatic fastener driving tools that acceptable bumper deterioration has been exceeded thereby to warn against further use of a tool prior to replacement of the bumper. A piston carrying a driver blade moves from an upper position of rest to lower fastener driven positions. The piston sealingly engages the cylinder wall via a sealing ring. As the bumper deteriorates, the piston moves to lower and lower fastener driven positions. When the piston reaches a predetermined lower position, the effectiveness of the sealing ring is impaired, as by engagement with a notch or edge which tends to destroy or dislodge the sealing ring. This allows high pressure air to escape past the sealing ring to signal that the bumper should be replaced, as by seriously reducing the effectiveness or operability of the tool or as by producing an audible signal by the escaping high pressure air, or both.

24 Claims, 9 Drawing Figures

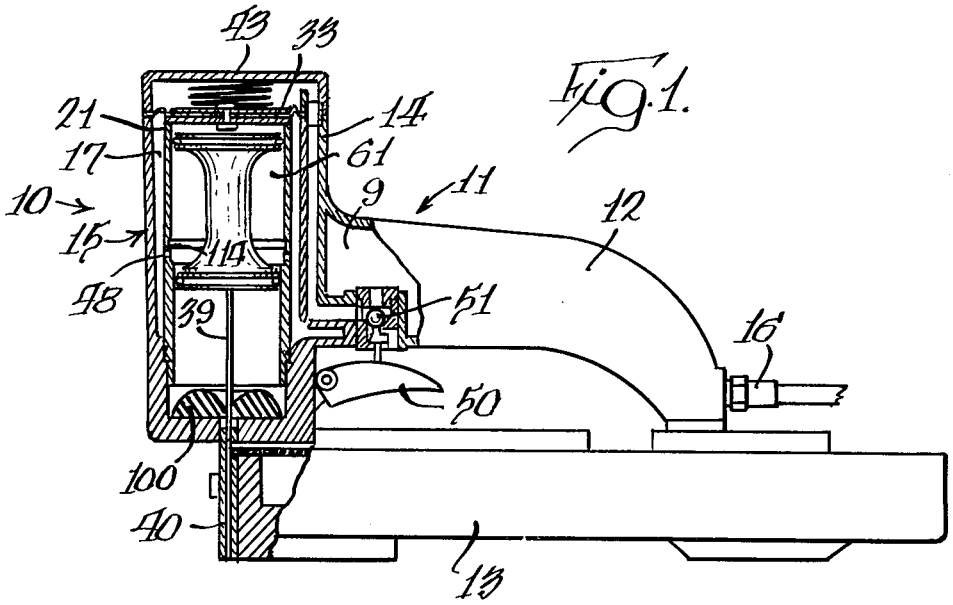
Fig. 1.
Fig. 2.
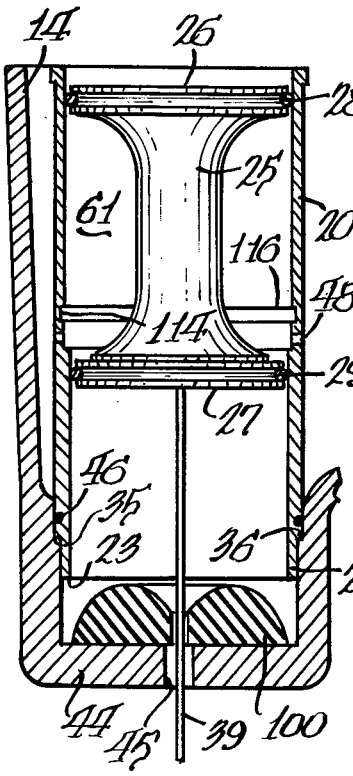
Fig. 3.
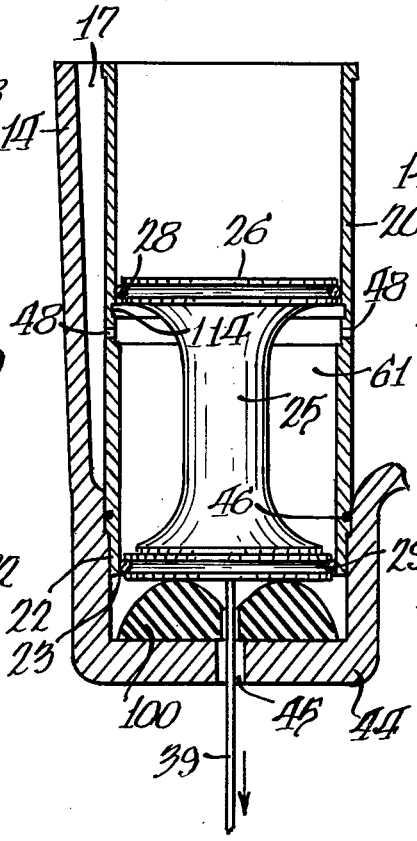
Fig. 4.
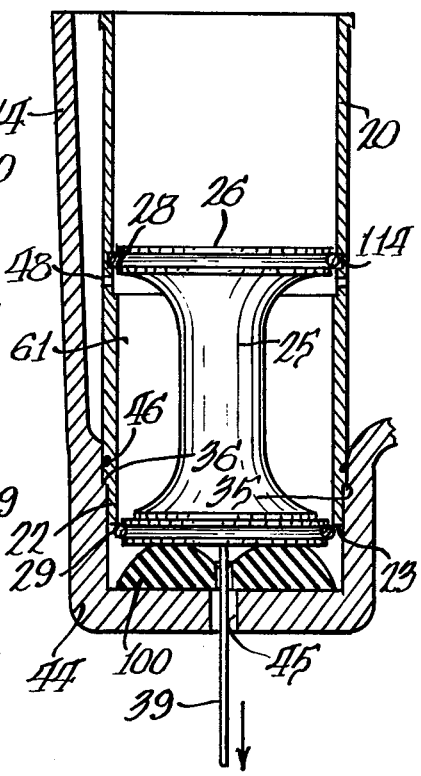

BUMPER DETERIORATION WARNING SYSTEM FOR FASTENER DRIVING TOOLS

BACKGROUND OF THE INVENTION

This invention relates to tools and particularly to fastener driving tools having a piston reciprocable in a cylinder under the influence of a pressurized fluid such as pressured air. The piston is movable between an upper rest position and lower driven fastener positions from which it is returnable to the upper rest position until the tool is again actuated to drive another fastener.

Fastener driving tools of this general type are well known. Most of those which are in use are pneumatically operated. Typical tools for driving fasteners such as staples, T-nails and the like are shown in U.S. Pat. Nos. 3,194,324, 3,815,475 and 3,822,819, each of which is owned by the assignee of the present application.

In certain of those patents the use of a rubber or rubber-like bumper is illustrated and described. The function of such a bumper is to engage the piston as it approaches the lower driven fastener position, to cushion its downward movement and to prevent its contacting the nosepiece of the tool or the end of the housing in which the cylinder is positioned.

It will be appreciated that as the tool is used, the bumper will gradually lose its resiliency and will tend to deteriorate and crumble. As that occurs, the travel of the piston will increase, i.e., the initial lower driven fastener position will become lower and lower until the piston approaches and finally contacts the nosepiece or the end of the housing confronting the piston. When the piston contacts the tool nosepiece or end portion of the housing there will be metal-to-metal contact. This will and does result in cracking and destruction of pistons, housings, cylinders, fastener driver blades, i.e., in tool damage and destruction. If metal-to-metal contact continues for relatively few driving cycles, the damage to the tool will require its extensive repair.

However, if the bumper can be maintained to prevent metal-to-metal contact, of course, such extensive tool damage resulting from such contact will be avoided. A means for preventing damage due to such tool-endangering metal-to-metal contact would be highly advantageous.

SUMMARY OF THE INVENTION

The present invention is particularly useful in tools, such as fastener driving tools, comprising a housing for connection to a source of high pressure air, a cylinder positioned in the housing and a piston in the cylinder and movable between an upper rest position and lower driven fastener positions. In such tools the piston carries a fastener driving means. The piston carries one or more sealing rings which sealingly engage the cylinder to prevent the passage of high pressure air therepast as the piston moves between the upper and lower positions. The housing includes an end portion beneath and in line with the piston and the driving means extends through the end of the housing. A shock absorbing bumper is positioned between the piston and the end portion to prevent contact between the piston and the end portion. Initially the bumper permits the piston to move to first lower driven fastener positions. As the bumper deteriorates with use and age, it permits the piston to move to progressively lower driven fastener positions closer to the end portion.

In accordance with this invention, to prevent such contact and to provide a signal that permissible bumper deterioration has been exceeded, means carried by the housing are positioned to impair the effectiveness of the sealing ring as by engaging and dislodging a sealing ring when the piston reaches a predetermined lower driven fastener position. When the sealing ring is so impaired the effectiveness of the tool will be seriously reduced, thereby to signal that the bumper should be replaced to minimize the possibility of tool damage.

Preferably the impairing means comprises engaging and disloging means comprising a notch into which said sealing ring may expand somewhat when the piston reaches the predetermined lower driven fastener position and may also include an edge, such as an annular edge against which the sealing ring abradingly bears.

In the preferred form the notch is disposed immediately below the cylinder and the annular edge means is the lowermost annular edge portion of the cylinder, although the notch may alternatively be formed in the sidewall of the cylinder at a location to intercept the sealing ring when it descends to the predetermined lower fastener driven position.

The piston may preferably comprise a spool piston, with each of the spools mounting a sealing ring and defining a high pressure chamber therebetween and wherein the lower of the sealing rings is the one which is positioned to be dislodged by the engaging and dislodging means, thereby to allow air to escape from the chamber to provide a signal that allowable bumper deterioration has been exceeded.

Further objects, features and advantages of this invention will become apparent from the following description and drawings.

BRIEF DESCRIPTION OF THE SEVERAL DRAWINGS

FIG. 1 is a side elevational view, partially in section, of a fastener driving tool incorporating the bumper deterioration warning system of this invention;

FIG. 2 is an enlarged view of a portion of FIG. 1 showing the piston in a rest position;

FIG. 3 is a view similar to FIG. 2 showing the piston in a fastener driven position;

FIG. 4 is a view similar to FIG. 3 showing the piston in a position in which bumper deterioration has been exceeded;

DETAILED DESCRIPTION

Figure 5:
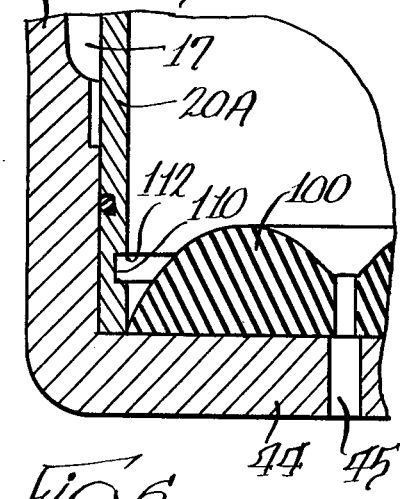
FIG. 5 is a fragmentary view similar to a portion of FIG. 2 showing a further embodiment of the bumper deterioration warning system of this invention.

While this invention is susceptible of embodiment in many different forms, there is shown in the drawings and will herein be described in detail several embodiments of the invention with the understanding that the present disclosure is to be considered as an exemplification of the principles of the invention and is not intended to limit the invention to the embodiments illustrated. The scope of the invention will be pointed out in the appended claims.

Referring first to FIGS. 1 to 4, a fastener driving tool 10 of this invention has a pneumatic motor assembly 15 which includes a cylinder 20 and a piston 25 slidably mounted within the cylinder 20.

Fastener driving tool 10 includes a hollow housing 11 having a graspable elongated chamber portion 12 mounted on a base 13 which may comprise a rail and magazine assembly. The chamber portion 12 defines a storage chamber 9 therein. Housing 11 also includes an upright upstanding motor housing portion 14 which houses the motor assembly 15. Housing portion 14 is closed at its lower end 44 except for a central port 45 and further comprises, at its upper end, a cap 43 for closing the upper end of housing portion 14. The storage chamber 9 is adapted to contain pressurized air and to be coupled to any suitable source of such air, as by a hose and coupling means 16.

Cylinder 20 is of a smaller diameter and of a lesser length than housing portion 14 and is centrally disposed therein so that an annular chamber 17 is defined between the outer wall of cylinder 20 and the inner wall of housing portion 14. The lower end 22 of cylinder 20 is sealed to the housing portion 14 by an O-ring 46 and the upper end 21 of the cylinder is sealed as by sealing disc 33, as in the manner described in U.S. Pat. No. 3,822,819. Chamber 17 is filled with pressurized air by being in direct communication with storage chamber 9.

Piston 25 is slidably mounted within cylinder 20. Piston 25 is generally spool-shaped and has upper and lower ends 26 and 27. Piston 25 is movable between cylinder ends 21 and 22 and is biased normally upwardly. To that end the piston 25 and cylinder 20 are constructed to define a chamber 61 which is supplied with pressurized air from chamber 17 via ports 48 in cylinder 20. Because the exposed area of the piston upper end 26 in chamber 61 is greater than that of the piston lower end 27 in chamber 61, an imbalance exists, thereby tending to maintain the piston in the up-position illustrated in FIGS. 1 and 2. When piston 25 is to be moved downwardly towards cylinder lower end 22, i.e., to drive a fastener, the trigger 50 is pulled to operate valve 51. This vents the high pressure air from above sealing disc 33 to atmosphere, permitting the high pressure air from chamber 9 to open the sealing disc, and to admit high pressure air to the cylinder 20 above piston end 26 as in the manner described in U.S. Pat. No. 3,822,819. The piston is then driven downwardly to a lower driven fastener position. Thereafter the trigger is released and high pressure air enters the space above the sealing disc to close the sealing disc, after which the piston is returned to its upper rest position by high pressure air in cylinder 61. It will be apparent that because chamber 61 is maintained at a relatively high pressure, the piston 25 and cylinder 20 must be in sealing engagement. To that end each of the spool piston ends 26 and 27 mount a sealing means such as sealing O-rings 28 and 29, respectively.

The lower end 27 of the piston carries an elongated fastener driver 39 that extends downwardly through the central port 45 and through rail and magazine assembly or base 13. Guide 40 may be part of the assembly 13 and is proportioned to guide the driver 39 and the particular fasteners to be driven which, in the embodiment illustrated, may be staples. The assembly 13 is adapted to hold staples to be supplied serially to guide 40 to be driven when the fastener driving tool is actuated, all as is typically described in U.S. Pat. No. 3,822,819. Of course, a base assembly mounting a nail magazine secured with a tool designed to drive nails rather than staples, such as described in U.S. Pat. Nos. 3,194,324 and 3,815,475 may be similarly used.

The latter two patents illustrate a further element usable with a tool such as is described in U.S. Pat. No. 3,822,819 and that is a bumper member. Bumper 100 is positioned between the lower end 27 of the piston and the lower end 44 of the housing portion 14. Its purpose is to dampen the shock loads and impact forces which would be imparted to the tool if it were not there. It prevents metal-to-metal contact, as between the lower piston end 27 and the lower end of the housing portion 14. Preferably bumper 100 is of an elastomeric material of known composition.

It is the fact that as a pneumatic fastener driving tool such as tool 10 is used, bumper 100 gradually wears, becomes set and deteriorates. As that occurs, piston 25 will move to fastener driven positions which are progressively lower and lower until, eventually, the piston or a piston portion will contact another portion of the tool, such as the housing lower end 44 in the embodiment illustrated or, in some tools, a nosepiece assembly that takes the place of a housing lower end. Such metal-to-metal contact transmits shock loads to the other parts of the tool and tends to shatter and crack pistons, housings, cylinder sleeves and driver blades, among others. Accordingly, such contact may frequently require expensive maintenance and replacement of tool parts.

The tool of FIGS. 1 to 4 eliminates that problem by the provision of a system or mechanism for warning of bumper deterioration by dislodging one of the sealing rings, such as one defining the chamber 61. As seen in FIGS. 1–4, the lower end 22 of cylinder 20 is positioned above the inner surface of the lower end 44 of the housing portion 20. With the housing 14, it defines a notch into which the O-ring 29 may expand and provides an inner annular edge 23 against which the O-ring 29 may abradingly bear. Edge 23 is positioned below the lowermost fastener driven position which is acceptable, i.e., one at which permissible bumper deterioration has been exceeded. The positioning of annular edge 23 is predetermined by properly locating a cylinder 20 of suitable length and proportioning in the housing portion 14. In the embodiment illustrated this is determined by seating the cylinder shoulder 35 on housing flange 36.

When the tool 10 is actuated, the piston 25 is driven in usual fashion downwardly from its position of rest (FIGS. 1 and 2) to a lower fastener driven position, such as is illustrated in FIG. 3. As the tool is used, the fastener driven position becomes progressively lower, due to deterioration of the bumper 100, until the piston end 27 carries lower sealing ring 29 downwardly to the annular edge 23 (see FIG. 4). Because the sealing ring 29 is tightly squeezed between the cylinder wall and the piston end it will tend to expand into the generally rectilinear notch defined by the lower surface of the cylinder and the housing wall below edge 23 and will tend to abradingly bear against and will tend to be cut by edge 23. It will take only relatively few cycles for the lower O-ring 29 to be dislodged, displaced or to be destroyed after it has contacted annular edge 23 or has begun to expand into the notch.

As soon as the sealing ring 29 is dislodged or destroyed, the seal which it provided is broken and the high pressure air which normally is trapped within chamber 61 will discharge and vent, as through central port 45. That will provide an audible indication that the tool 10 is not fully operative and will also result in malfunctioning of the tool. This will serve as an indication and warning that the tool should be serviced by replacement of the unduly worn bumper and will have prevented damage to the tool.

As shown in FIG. 5, rather than elevating the cylinder 20 to provide a lower annular edge 23 for engaging the O-ring at the predetermined lower fastener driven position, a suitable configured cylinder 20A may be substituted. There a notch 110 near the lower end is provided. Notch 110 provides an upper annular edge 112. Notch 110 and edge 112 are adapted to function in the same manner, respectively, as the space below cylinder end 20 and edge 23 were described to function in connection with FIGS. 1 to 4, inclusive.

FIGS. 1 to 4 also illustrate an alternate or supplemental notch 114 and annular edge 116 near the upper piston end 26 which are proportioned to interact with an upper sealing ring 28 in the same manner described with respect to the lower sealing ring. If only an upper seal engaging and dislodging means is used (such as 114 and 116) when the seal is broken air from chamber 61 will escape, will expose the uppermost surface of the upper piston end 26 to high pressure air, and will tend to maintain the piston in a down position. That will serve as a warning and indication that the bumper should be replaced.

Figure 8:
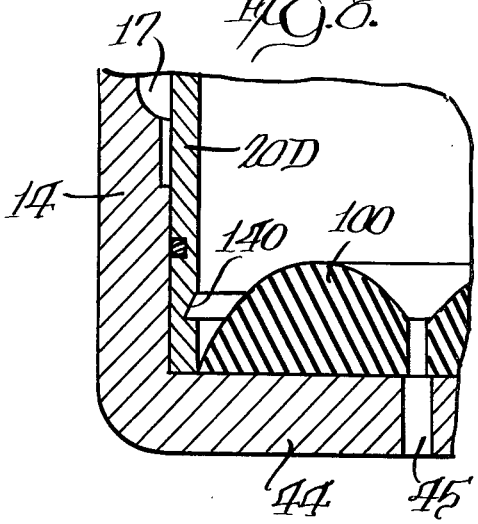
FIGS. 6, 7 and 8 are fragmentary views similar to FIG. 5 showing further embodiments of the bumper deterioration warning system of this invention.
Figure 6:
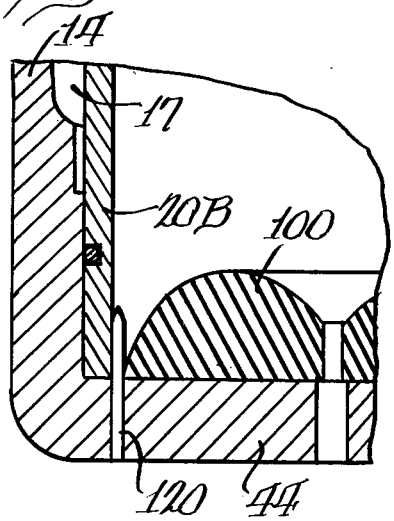
Figure 7:
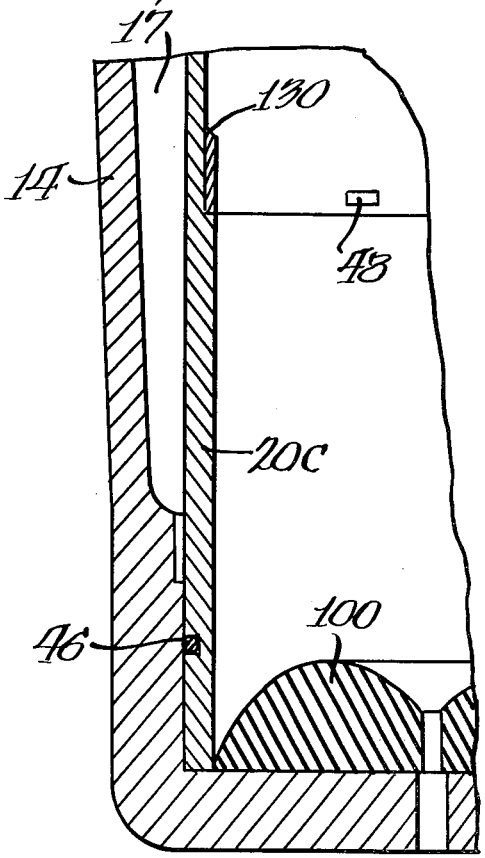

Other embodiments of this invention are illustrated in FIGS. 6 to 8. In FIG. 6, a vertically extending projection or pin 120 is mounted in housing portion 14 within cylinder 20B. It is positioned to engage an O-ring, such as O-ring 29 when the piston reaches a predetermined lower fastener driven position. After O-ring 29 is indented, it will rapidly self-destruct, again providing a signal, as by breaking the seal to chamber 61, that permissible bumper deterioration has been exceeded.

In FIG. 7 a horizontal projection comprising an inwardly extending and horizontally disposed projection comprising a narrow knife edge 130 is shown to be mounted in cylinder 20C to intersect a piston mounted sealing ring such as O-ring 28 when the piston reaches a predetermined lower fastener driven position. Here again, once the O-ring is nicked or indented, it will tend rapidly to self-destruct.

In FIG. 8, a notch 140 of triangular shape in cross-section in cylinder 20D is illustrated. Although this does not provide a relatively sharp and therefore abrading edge, such as were edges 23 or 112, because the O-ring will expand and rubbingly contact the notch surface as it descends into the notch 140, upon repeated passage into and out of the notch, the O-ring will tend to become dislodged or destroyed. The intended seal provided by the O-ring will be broken and the tool will become inoperative or will otherwise provide a signal, such as an audible signal, all prior to metal-to-metal contact between the parts which would otherwise cause the tool to tend to damage itself.

To promote dislodgment of the O-ring to be destroyed or dislodged, it has been found to be desirable in some tools to form the piston end at which the seal is to be broken with a reduced diameter portion at its very end, as at 150, and intersecting the groove in which the O-ring is mounted. This will enhance the displacement of the O-ring and is illustrated in FIG. 9.

Figure 9:
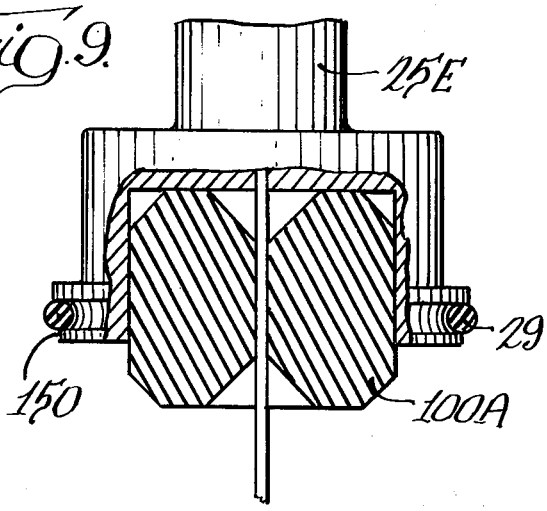
FIG. 9 is an enlarged view similar to a portion of FIG. 1 in which the bumper is shown as being carried by the piston.

Although the embodiments of FIGS. 1 to 8 show the bumper 100 as seated against the inner surface of lower end 44, it is also possible to utilize the tool protection system of this invention with a bumper 100A carried by a piston 25E, as is illustrated by FIG. 9. In each case, the O-ring displacement means is positioned at an elevation such that the O-ring will be dislodged or destroyed before the bumper allows the piston to reach a lower fastener driven position at which metal-to-metal contact will occur.

Of course, the specific placement of the sealing ring displacement means will depend upon the particular tool, the air pressure to be used and permissible spacing between the piston and the portion of the tool which it would contact in metal-to-metal engagement which an engineer deems satisfactory.

What is claimed is:

1. In a driving tool having a cylinder and a piston in said cylinder movable relative to said cylinder between an upper rest position and lower positions therein and wherein said piston carries at least one sealing ring sealingly engaging said cylinder, and a shock absorbing bumper against which said piston moves to progressively lower positions as said bumper deteriorates, means for impairing the effectiveness of said sealing ring when allowable bumper deterioration has been exceeded by engaging and dislodging said sealing ring when said piston reaches a predetermined lower position, whereby the effectiveness of the tool will be seriously reduced and signal that the bumper should be replaced.

2. A tool in accordance with claim 1 in which said means for impairing the effectiveness of said sealing ring comprises an edge means defined by said cylinder.

3. A tool in accordance with claim 2 in which said edge means is a lowermost annular edge portion of said cylinder.

4. A tool in accordance with claim 1 wherein said means for impairing the effectiveness of said sealing ring comprises notch means.

5. A tool in accordance with claim 4 wherein said piston carries at least two sealing rings which are vertically spaced, and wherein the lower of the sealing rings is the one which is positioned to be engaged by said impairing means.

6. A tool in accordance with claim 5 wherein said piston is a spool piston.

7. A tool in accordance with claim 6 wherein said spool piston defines an enclosed chamber with said cylinder, and further characterized by means for supplying pressurized air to said chamber, whereby when the effectiveness of said lower sealing ring is impaired, air escapes from said chamber to signal that said bumper should be replaced.

8. A tool in accordance with claim 7 further characterized by a fastener driving means secured to said piston and wherein said cylinder is in a housing, said bumper being positioned between said piston and a lower end portion of said housing and said fastener driving means extends outwardly through said lower end portion.

9. A fastener driving tool comprising a housing for connection to a source of high pressure air, a cylinder positioned in said housing, a piston in said cylinder and movable between an upper rest position and lower driven fastener positions, said piston carrying a fastener driving means, sealing ring means carried by said piston and sealingly engaging said cylinder to prevent the passage of high pressure air therepast as said piston moves between said upper and lower positions, said housing comprising an end portion beneath said piston through which said driving means extends, a shock absorbing bumper between said piston and said end portion to prevent contact between said piston and said end portion, said bumper initially permitting said piston to move to first lower driven fastener positions and then, as said bumper deteriorates with use, permitting said piston to move to progressively lower driven fastener positions closer to said end portion, and means carried by said housing which is positioned for engaging and dislodging said sealing ring means when said piston reaches a predetermined lower driven fastener position.

10. A fastener driving tool in accordance with claim 9 wherein said engaging and dislodging means comprises a notch into which said sealing ring expands when said piston reaches said predetermined lower driven fastener position.

11. A fastener driving tool in accordance with claim 9 in which said engaging and dislodging means comprise edge means defined by said cylinder.

12. A fastener driving tool in accordance with claim 11 in which said edge means is a lowermost annular edge portion of said cylinder.

13. A fastener driving tool in accordance with claim 11 wherein said cylinder defines a notch in its wall and said edge means defined by said cylinder is an edge portion of said notch.

14. A fastener driving tool in accordance with claim 13 wherein said notch is an annular notch and said edge portion is an annular edge portion.

15. A fastener driving tool in accordance with claim 9 wherein said sealing ring means comprises at least two vertically spaced sealing rings, and wherein the lower of the sealing rings is the one which is positioned to be dislodged by said engaging and dislodging means.

16. A fastener driving tool in accordance with claim 9 wherein said engaging and dislodging means comprises a projection which contacts said sealing ring means when said piston reaches said predetermined lower driven fastener position.

17. A fastener driving tool in accordance with claim 16 wherein said projection projects horizontally inwardly of said cylinder.

18. A fastener driving tool in accordance with claim 16 wherein said projection projects upwardly from said end portion.

19. A fastener driving tool comprising a housing for connection to a source of high pressure air and having a lower end portion, a cylinder positioned in said housing in line with said lower end portion, a piston and fastener driving means in said cylinder and movable between an upper rest position remote from, and lower driven fastener positions closer to, said lower end portion, sealing ring means carried by said piston and sealingly engaging said cylinder to prevent the passage of high pressure air between said piston and said cylinder thereat, a shock absorbing bumper between said piston and said end portion, said bumper initially permitting said piston to move to first lower driven fastener positions and then, as said bumper deteriorates with use, permitting said piston to move to progressively lower driven fastener positions closer to said end portion, and notch means defined by said cylinder for engaging and dislodging said sealing ring means when said piston reaches a predetermined lower driven fastener position.

20. A fastener driving tool in accordance with claim 19 in which said notch means comprises an annular notch positioned below said cylinder.

21. A fastener driving tool in accordance with claim 19 wherein said notch means is defined by said cylinder.

22. A fastener driving tool in accordance with claim 19 wherein said notch means is generally rectilinear in cross-section.

23. A fastener driving tool in accordance with claim 19 wherein said sealing ring means comprises at least two vertically spaced sealing rings, and wherein the lower of the sealing rings is the one which is positioned to be dislodged by said notch means.

24. A fastener driving tool in accordance with claim 23 wherein said notch means comprises an annular notch positioned below said cylinder and wherein said piston is a spool piston, each of the spool portions thereof carrying one of said sealing rings, and wherein said piston and said cylinder define an enclosed chamber between said sealing rings which is supplied with high pressure air, whereby when said lower sealing ring is dislodged air will escape from said chamber to provide a signal that allowable bumper deterioration has been exceeded.

* * * * *